US008033431B2

(12) United States Patent
Sommerfield et al.

(10) Patent No.: US 8,033,431 B2
(45) Date of Patent: Oct. 11, 2011

(54) WINE PRESERVATION AND DISPENSING APPARATUS

(75) Inventors: Matthew A. Sommerfield, Allentown, PA (US); Steven DiDonato, Harleysville, PA (US)

(73) Assignee: Wine Gadgets, LLC, Coopersburg, PA (US)

( * ) Notice: Subject to any disclaimer, the term of this patent is extended or adjusted under 35 U.S.C. 154(b) by 1177 days.

(21) Appl. No.: 11/797,681

(22) Filed: May 7, 2007

(65) Prior Publication Data

US 2008/0277422 A1 Nov. 13, 2008

(51) Int. Cl.
*B67D 1/08* (2006.01)
*B65D 83/00* (2006.01)

(52) U.S. Cl. ..... 222/152; 222/399; 222/394; 222/129

(58) Field of Classification Search ..... 222/152, 222/190, 399, 396, 397, 394, 146.6, 129.1–129.4, 222/132, 136, 144.5, 325; 248/313, 309.1, 248/107, 105

See application file for complete search history.

(56) References Cited

U.S. PATENT DOCUMENTS

| | | | | | |
|---|---|---|---|---|---|
| 1,705,940 | A | * | 3/1929 | Moisant | 222/205 |
| 2,255,280 | A | * | 9/1941 | Donald | 312/322 |
| 2,732,977 | A | * | 1/1956 | Charpiat | 222/131 |
| 2,750,752 | A | * | 6/1956 | Yorgey, Jr. | 222/397 |
| 3,883,043 | A | | 5/1975 | Lane | |
| 3,953,550 | A | * | 4/1976 | Gilbey | 261/64.3 |
| 3,976,222 | A | | 8/1976 | Spagnolo | |
| 4,392,578 | A | * | 7/1983 | Fipp et al. | 215/231 |
| 4,401,016 | A | * | 8/1983 | Adams et al. | 99/323.1 |
| 4,473,174 | A | | 9/1984 | Heuser | |
| 4,477,477 | A | * | 10/1984 | Arter | 426/330.4 |
| 4,595,121 | A | | 6/1986 | Schultz | |
| 4,624,391 | A | | 11/1986 | Shannon | |
| 4,655,425 | A | * | 4/1987 | Wallace et al. | 248/311.2 |
| 4,691,842 | A | * | 9/1987 | Foures | 222/1 |
| 4,702,396 | A | | 10/1987 | Gwiazda | |
| 4,706,847 | A | | 11/1987 | Sankey et al. | |
| 4,856,680 | A | | 8/1989 | Sitton | |
| 4,932,561 | A | | 6/1990 | Boxall | |
| 4,984,711 | A | | 1/1991 | Ellis | |
| 5,022,565 | A | * | 6/1991 | Sturman et al. | 222/396 |
| 5,344,055 | A | * | 9/1994 | Edwards | 224/401 |
| 5,349,993 | A | | 9/1994 | Casey | |

(Continued)

FOREIGN PATENT DOCUMENTS

EP 0930267 7/1999

(Continued)

*Primary Examiner* — Kevin P Shaver
*Assistant Examiner* — Stephanie E Williams
(74) *Attorney, Agent, or Firm* — Welsh Flaxman & Gitler LLC

(57) ABSTRACT

A preservation and dispensing apparatus includes a pressurized gas supply assembly for pressurizing and dispensing fluid from a bottle in a manner that effectively creates a barrier protecting the fluid from harmful effects of oxygen. The pressurized gas supply assembly includes an inert gas output linked to the bottle via a dispensing nozzle secured within an opening of the bottle. The dispensing nozzle includes a connecting seal having a series of outwardly directed, flexible fins composed of a first material and an outwardly tapered seal member composed of a second material. The inert gas output includes a regulator assembly having a piercing pin that passes through an end cap of a gas capsule allowing gas from the gas capsule to pass through the regulator assembly. The regulator assembly reduces the gas pressure from approximately 2700 psi to approximately 5 psi in a single step.

14 Claims, 5 Drawing Sheets

U.S. PATENT DOCUMENTS

| | | | | |
|---|---|---|---|---|
| 5,390,832 | A | 2/1995 | Lombardo | |
| 5,397,027 | A * | 3/1995 | Koch et al. | 222/1 |
| 5,565,149 | A | 10/1996 | Page et al. | |
| 5,839,709 | A * | 11/1998 | Leonard | 248/311.2 |
| 5,979,713 | A | 11/1999 | Grill | |
| 6,557,459 | B1 | 5/2003 | Phelps et al. | |
| 6,607,100 | B2 | 8/2003 | Phelps et al. | |
| 6,913,167 | B2 | 7/2005 | Phelps et al. | |
| 7,047,762 | B2 | 5/2006 | Luzaich et al. | |
| D585,228 | S * | 1/2009 | Sommerfield | D7/307 |
| 7,712,637 | B2 * | 5/2010 | Lambrecht | 222/400.7 |
| 2003/0213814 | A1 | 11/2003 | Phelps et al. | |
| 2005/0103804 | A1 | 5/2005 | Waters | |
| 2005/0150549 | A1 | 7/2005 | Gosi et al. | |

FOREIGN PATENT DOCUMENTS

| | | |
|---|---|---|
| WO | WO03/084860 | 10/2003 |
| WO | WO2005/040035 | 5/2005 |

* cited by examiner

FIG. 4
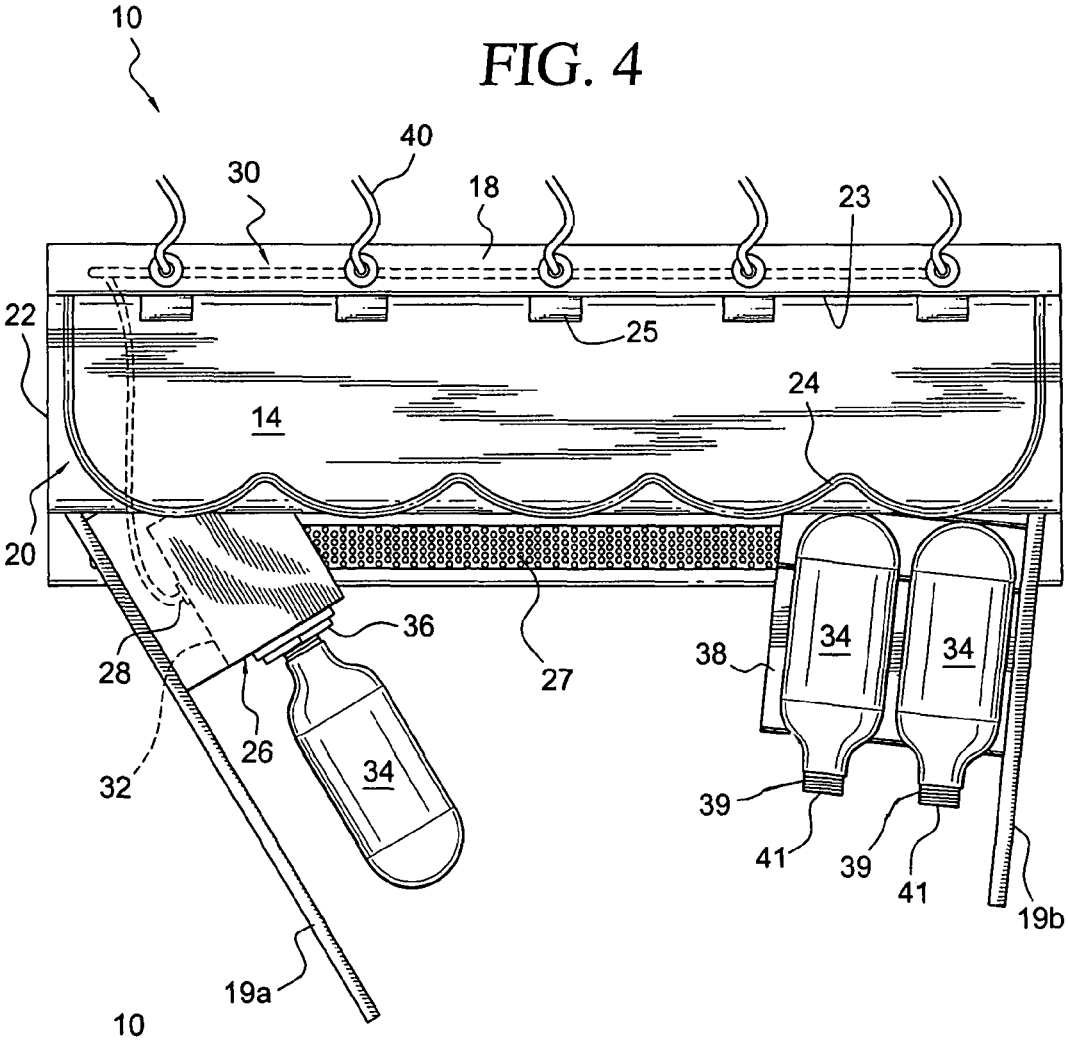
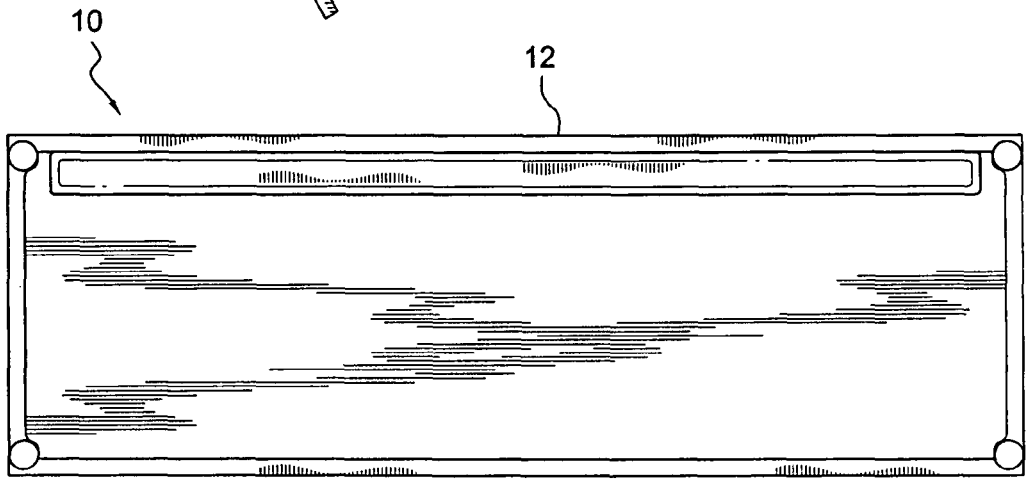
FIG. 6

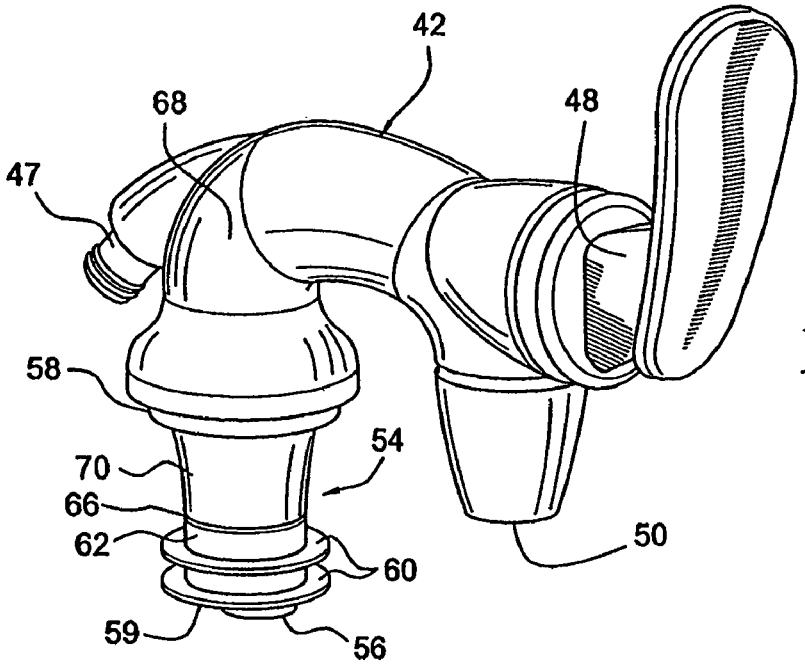
FIG. 7
FIG. 8
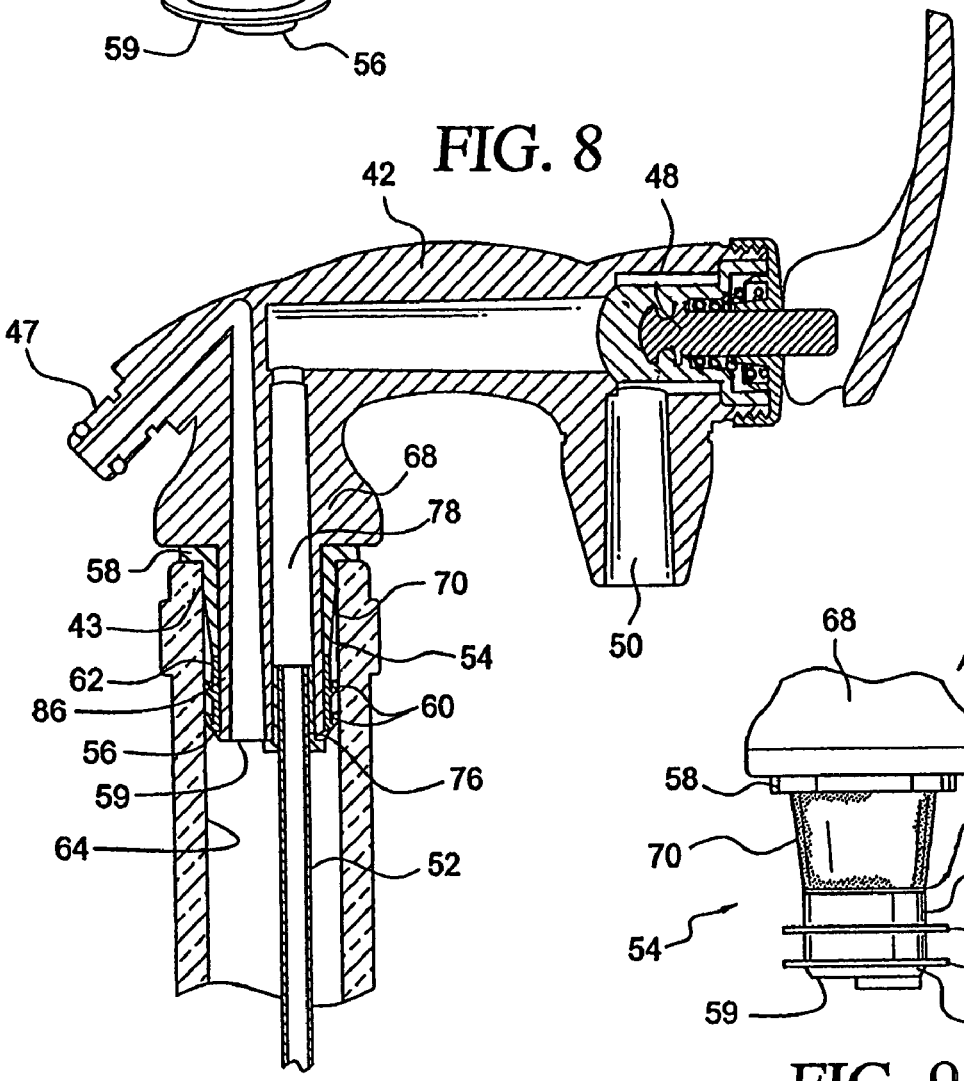
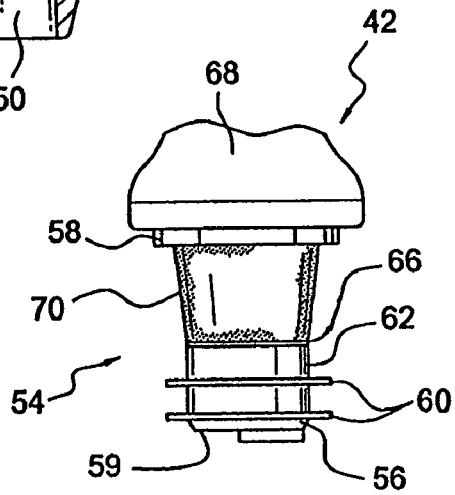
FIG. 9

WINE PRESERVATION AND DISPENSING APPARATUS

BACKGROUND OF THE INVENTION

1. Field of the Invention

The invention relates to a wine preservation and dispensing apparatus. More particularly, the invention relates to a seal assembly for a dispensing nozzle.

2. Description of the Related Art

Wine is a very popular beverage, and its popularity within the United States has recently increased substantially. Most wine is distributed to consumers in bottles that are sealed with a cork to prevent exposure to the air and to preserve the wine. Since removal of the cork exposes the wine to air and ultimately oxidation of the wine, wine will begin to degrade as soon as the wine bottle is open. As such, many people will only drink wine when they are drinking an entire bottle. In addition, many restaurants and bars require most wines to be bought by the bottle and offer a limited number of wine choices for those wishing to purchase only a single glass of wine.

More particularly, those skilled in the art will appreciate that from the instant one opens a bottle of wine the air begins to affect the character of the wine. This is a process known as oxidation and is readily recognizable. While it is widely held that allowing the wine to "breathe" is beneficial, it is the opinion of many people excessive exposure to air can negatively affect the wine's taste. In fact, it is understood oxidation can begin to break down the character of a young, red wine in as little as six hours, while white wines and older red wines may begin to suffer in only two hours. This means some wine drinkers will be able to notice a reduction in the aromatic qualities of the wine, a negative change in the color of the wine and flat, stale and/or lifeless taste in the wine.

With the foregoing in mind, attempts have been made to reduce the oxidation and degradation of wine once a wine bottle is opened. While these attempts have achieved some success, a need continues to exist for a system which will provide for the preservation and dispensing of wine in a manner allowing an individual to only drink a single glass of wine and save the remainder for a later time or allow a restaurant to serve wine by the glass without worrying the wine sold later to another consumer is of a lower quality than the wine when it was initially opened.

The present invention addresses these problems by providing a wine preservation and dispensing system which may be utilized by either a restaurant/bar or a home consumer.

SUMMARY OF THE INVENTION

It is, therefore, an object of the present invention to provide a preservation and dispensing apparatus including a housing having a bottle support assembly and a pressurized gas supply assembly for pressurizing and dispensing fluid from a bottle supported by the apparatus through the utilization of an inert gas in a manner that effectively creates a barrier protecting the fluid from harmful effects of oxygen. The pressurized gas supply assembly includes an inert gas output linked to the bottle via a conduit arrangement and a dispensing nozzle selectively secured within an opening of the bottle. The dispensing nozzle includes a connecting seal for attaching the dispensing nozzle within the opening of the bottle. The connecting seal includes a first end and a second end, the first end being adjacent a free end of the connecting seal and provided with a series of outwardly directed, flexible fins composed of a first material. The connecting seal further includes an outwardly tapered seal member composed of a second material and extending from a central portion of the connecting seal to the second end of the connecting seal, wherein the first material and the second material are different.

It is also an object of the present invention to provide a preservation and dispensing apparatus wherein the housing includes a bottle support assembly including a base, a rear wall and a retaining member, and spring members are provided on the rear wall to assist in securely supporting a bottle between the rear wall and the retaining member.

It is also another object of the present invention to provide a preservation and dispensing apparatus wherein the spring members are convex leaf springs facing outwardly.

It is also a further object of the present invention to provide a preservation and dispensing apparatus wherein the inert gas is argon.

It is another object of the present invention to provide a preservation and dispensing apparatus wherein the inert gas output includes a regulator assembly to which a gas capsule is selectively secured.

It is still another object of the present invention to provide a preservation and dispensing apparatus wherein the regulator assembly includes a piercing pin that passes through an end cap of the gas capsule allowing gas from the gas capsule to pass through the regulator assembly.

It is yet another object of the present invention to provide a preservation and dispensing apparatus wherein the regulator assembly reduces the gas pressure from approximately 2700 psi to approximately 5 psi.

It is also an object of the present invention to provide a preservation and dispensing apparatus wherein the regulator assembly reduces pressure in a single step.

It is also a further object of the present invention to provide a preservation and dispensing apparatus wherein the regulator assembly includes a dump valve which monitors coupling of the gas capsule to the regulator assembly and releases pressure in the event a full or partially filled gas capsule is being removed.

It is still a further object of the present invention to provide a preservation and dispensing apparatus wherein the regulator assembly includes a burst prevention system that will release pressure in the event undesirably high pressure is identified as coming from the gas capsule.

It is yet a further object of the present invention to provide a preservation and dispensing apparatus wherein the housing includes a bottom storage compartment and the inert gas output is stored within the storage compartment.

It is also an object of the present invention to provide a preservation and dispensing apparatus wherein the storage compartment includes a door, and the inert gas output is mounted to the door such that it pivots outwardly in a manner openly revealing the inert gas output.

It is also another object of the present invention to provide a preservation and dispensing apparatus wherein the dispensing nozzles includes an draw tube which is mounted for telescopic movement within an outlet lumen of the dispensing nozzle.

It is also a further object of the present invention to provide a preservation and dispensing apparatus wherein the flexible fins are composed of EVA.

It is another object of the present invention to provide a preservation and dispensing apparatus wherein the seal member is composed of rubber.

It is a further object of the present invention to provide a preservation and dispensing apparatus wherein the seal member is composed of silicone rubber.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 4 is a top plan view of the apparatus shown in FIG. 1 with the storage compartment doors open.

FIG. 6 is a bottom plan view of the apparatus shown in FIG. 1.

FIG. 7 is a detailed view of the dispensing nozzle in accordance with the present invention.

FIG. 8 is a cross sectional view of the dispensing nozzle shown in FIG. 7.

FIG. 9 is a detailed view of the connecting seal of the dispensing nozzle.

DESCRIPTION OF THE PREFERRED EMBODIMENT

Figure 1:
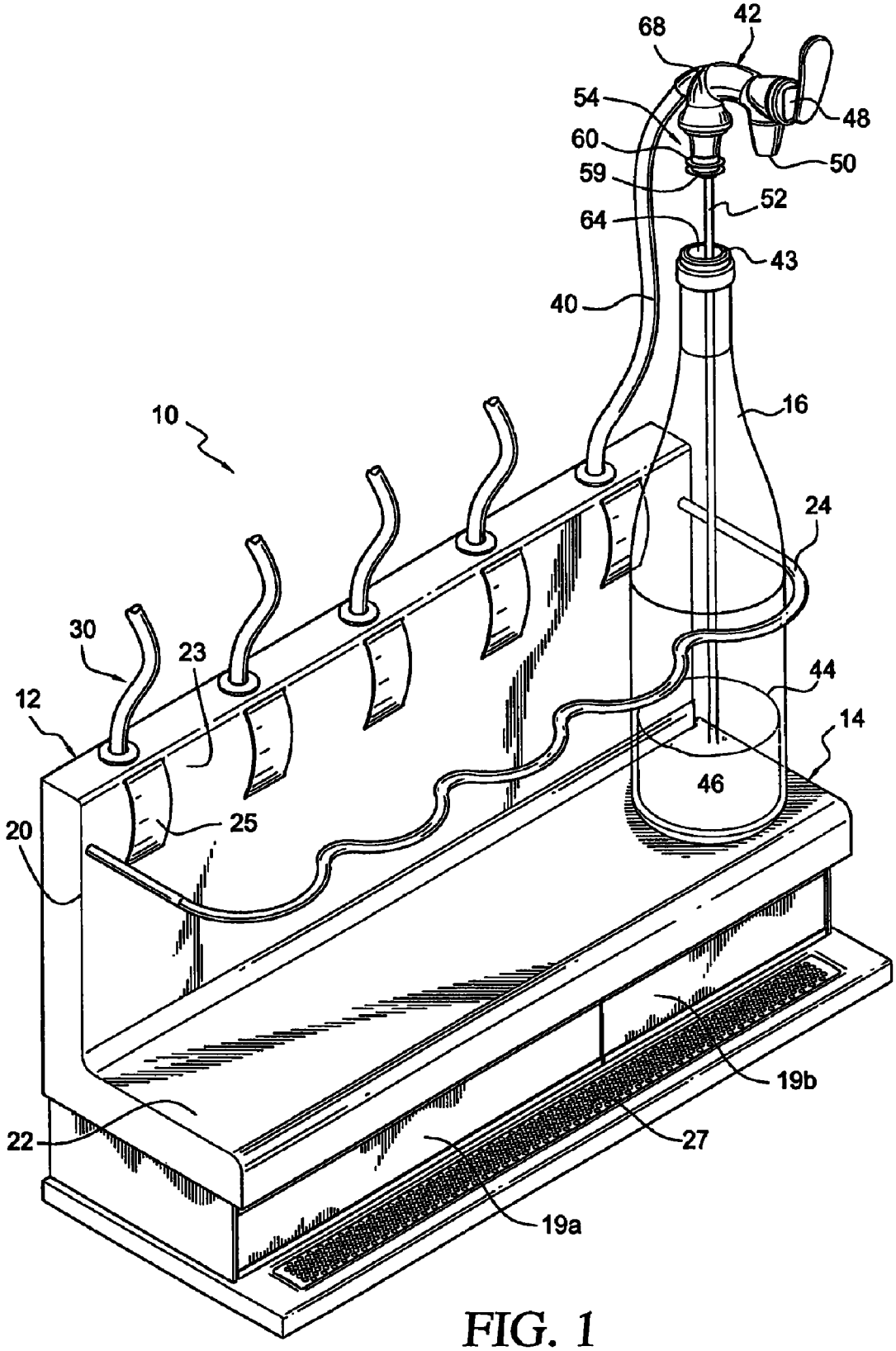
FIG. 1 is a perspective view of the preservation and dispensing apparatus in accordance with the present invention.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to the various figures, a preservation and dispensing apparatus 10 is disclosed. Although the present preservation and dispensing apparatus 10 is disclosed in accordance with a preferred embodiment for use in conjunction with the preservation and dispensing of wine, the present apparatus 10 may be used for the dispensing of other liquid products without departing from the spirit of the present invention. As the following disclosure will reveal, the present apparatus 10 is portable and provides a self-contained apparatus that may be conveniently installed and/or removed without connection to any remote gas sources.

Many restaurants have learned that it is highly desirable, and profitable, to offer consumers wine by the glass as opposed to requiring consumers to purchase a full bottle of the wine. However, with this service comes the problem of preserving the wine remaining in a bottle after a consumer has ordered a single glass and before the bottle is finished by others ordering the same wine. With this in mind, the present wine preservation and dispensing apparatus 10 has been developed. It will be appreciated by those skilled in the art that, although a preferred embodiment disclosed herein shows an apparatus suitable for holding five bottles of wine, the present apparatus may readily be adapted for use with more or less dispensing stations without departing from the spirit of the present invention.

The apparatus 10 includes a housing 12 having a support platform 14 upon which multiple wine bottles 16 are supported, a bottom storage compartment 18 in which the underlying working components are stored and hidden from view and a rear cavity 19 in which the tubes bringing gas to the wine bottles 16 are hidden from view. More particularly, the support platform 14 is composed of a container or bottle support assembly 20 including a base 22, a rear wall 23 and a retaining member 24. The base 22, rear wall 23 and retaining member 24 are shaped and dimensioned to support wine bottles 16 in an upright configuration for ease of use and ready replacement of the wine bottles 16. Spring members 25 are provided on the rear wall 23 to assist in securely supporting the wine bottles 16. The spring members 25 are convex leaf springs facing outwardly such that they engage wine bottles 16 to push them away from the rear wall 23 and toward the retaining member 24. While metal leaf springs are contemplated for use in accordance with a preferred embodiment of the present invention, those skilled in the art will appreciate a variety of known materials, for example, plastics, may be used without departing from the spirit of the present invention. This creates a frictional engagement between the spring member 25, the retaining member 24 and the wine bottle 16 to securely hold the wine bottle 16 to the bottom support assembly 20. In accordance with a preferred embodiment of the present invention, a drip pan 27 is also positioned beneath the base 22 to catch any wine that may drip from the dispensing nozzle 42 during use thereof.

The apparatus 10 also includes a pressurized gas supply assembly 26. As will be discussed below in greater detail, the pressurized gas supply assembly 26 provides the necessary pressure for forcing wine 46 from the wine bottles 16 through the dispensing nozzle 42. The pressurized gas supply assembly 26 also provides a mechanism for pressurizing the wine 46 through the utilization of argon gas in a manner that effectively creates a barrier protecting the wine 46 from the harmful effects of oxygen. Argon gas is inert and stable, and many times denser than nitrogen. For these reasons, it is far superior as a wine preservative. It envelopes the wine 46 and keeps out the harmful effects of oxidation. In fact, many high caliber wine producers use argon to replace the negative, degenerate qualities of oxygen in their wine making.

The pressurized gas supply assembly 26 includes an inert gas output 28 which is linked to the various wine bottles 16 via a conduit arrangement 30 composed of flexible tubing and a dispensing nozzle 42 selectively secured to, that is, within, the openings 43 of the wine bottles 16. In particular, inert gas output 28 includes a regulator assembly 32 to which an argon gas capsule 34 is selectively secured via a threaded coupling arrangement 36 for supplying argon gas in accordance with the present invention. The threaded coupling arrangement 36 includes a piercing pin 37 shaped and dimensioned to puncture the sealed coupling end 39 of a new gas capsule 34 as it is secured to the regulator assembly 32. In particularly, a new gas capsule 34 will have a sealed coupling end 39 with external threading shaped and dimensioned to mate with the threading of the threaded coupling arrangement 36 and an end cap 41 shaped and dimensioned for penetration by the piercing pin 37. As the gas capsule 34 is secured to the regulator assembly 32, the piercing pin 37 passes through the end cap 41 of the gas capsule 34 allowing gas from the gas capsule 34 to pass through the piercing pin 37 and the remainder of the regulator assembly 32, and to the various wine bottles 16 connected to the apparatus 10 in accordance with the present invention. A tight seal between the threaded coupling arrangement 36 and the gas capsule 34 is ensured by the placement of a rubber gasket 84 between the gas capsule 34 and the body of the threaded coupling arrangement 36.

The regulator assembly 32 allows for the utilization of argon gas maintained at high pressure, but which may be shipped in non-hazardous containers of less that 4 (four) fluid ounces. In particular, the regulator assembly 32 is able to reduce the pressure of the argon gas as maintained within the gas capsule 34 from 2700 psi to 5 psi for use in accordance with the present invention.

The regulator assembly 32 used in accordance with the present invention provides for enhanced performance and improved safety. In accordance with a preferred embodiment, the regulator assembly is manufactured by Leland Gas Technologies and is sold as Model No. 50043 of the NR 30 fixed series. In particular, by providing a pressure drop from 2700 psi to 5 psi in a single step, the argon gas is transferred from the gas capsule 34 at a useful pressure without the need for a multiple step pressure reduction. This improves the efficiency in applying gas pressure to the wine and allows for a relatively compact system which may be readily installed and used in a wide variety of locations.

As to safety issues, the regulator assembly 32 is provided with a dump valve 80 which monitors coupling of the gas capsule 34 to the threaded coupling arrangement 36 of the regulator assembly 32 and releases pressure within the system in the event it senses a full or partially filled gas capsule 34 is being removed from the threaded coupling arrangement 36 since the force of the gas escaping the gas capsule 34 might cause substantial damage. The regulator assembly 32 also includes a burst prevention system 82 composed of a rupture disk that will release pressure in the event undesirably high pressure is identified as coming from the gas capsule 34.

As those skilled in the art will appreciate, an argon gas capsule 34 will only hold a limited amount of argon gas and replacement capsules will be consequently required. As such, the bottom storage compartment 18 of the present apparatus 10 is provided with a capsule support 38 for storing multiple replacement argon gas capsules such that when one is used up, the operator of the present apparatus 10 may readily retrieve an additional capsule and replace the used capsule.

Access to the bottom storage compartment 18 in which the gas capsules 34 and the regulator assembly 32 are found is achieved by providing the bottom storage compartment 18 with doors 19*a*, 19*b* that pivotally open to reveal the working components and allow for ready access. In fact, access is further improved by securing the valve and regulator assembly 32 to one of the doors 19*a* such that it pivots outwardly in a manner openly revealing the regulator assembly 32 and the gas capsule 34 secured thereto.

As discussed above, the argon gas capsule 34 is linked to the various wine bottles 16 via a conduit arrangement 30. The conduit arrangement 30 is composed of various tubes 40 connected to respective dispensing nozzles 42. More particularly, connection members 45 at the ends of the tubes 40 are secured to gas inlets 47 of the dispensing nozzles 42. In accordance with a preferred embodiment, the connection members are quick disconnect assemblies well known to those skilled in the art. The dispensing nozzles 42 are selectively secured within the openings 43 of wine bottles 16.

Figure 2:
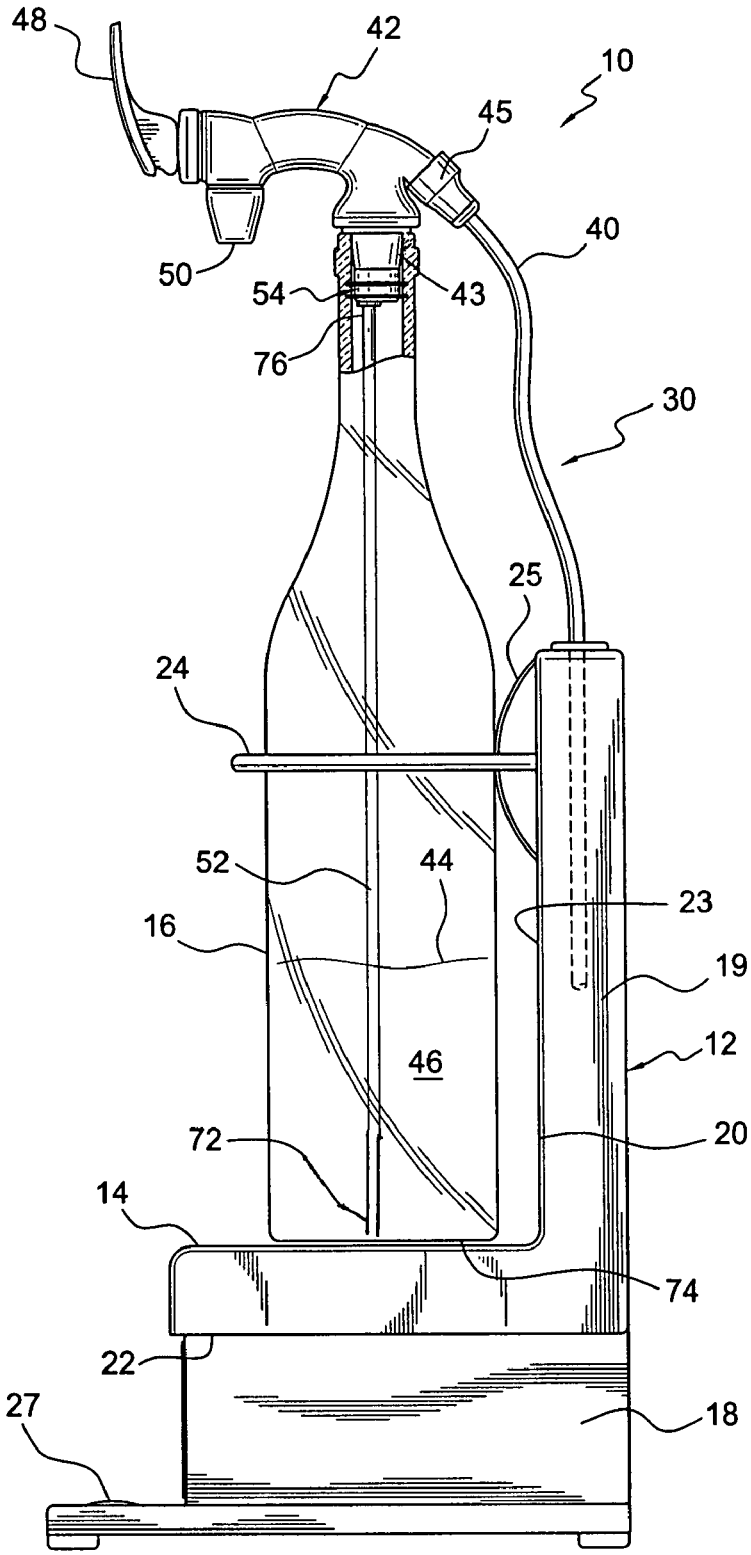
FIG. 2 is side view of the apparatus shown in FIG. 1.
Figure 3:
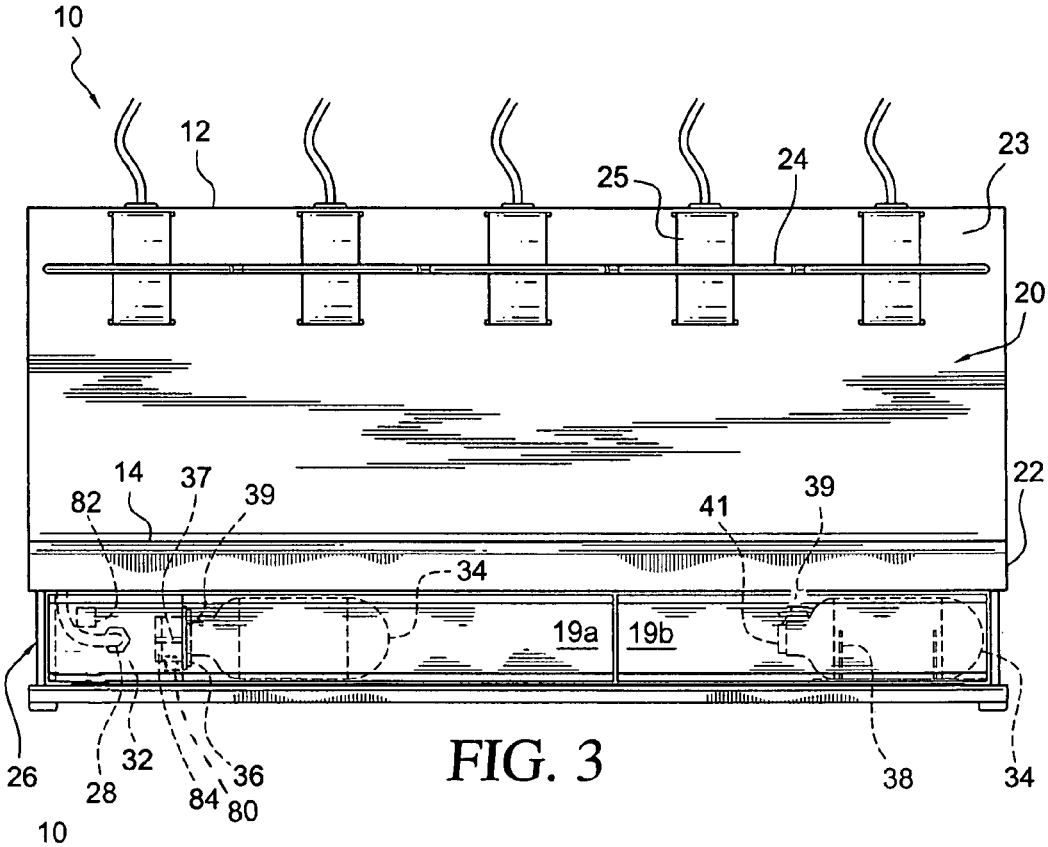
FIG. 3 is a front plan view of the apparatus shown in FIG. 1.
Figure 5:
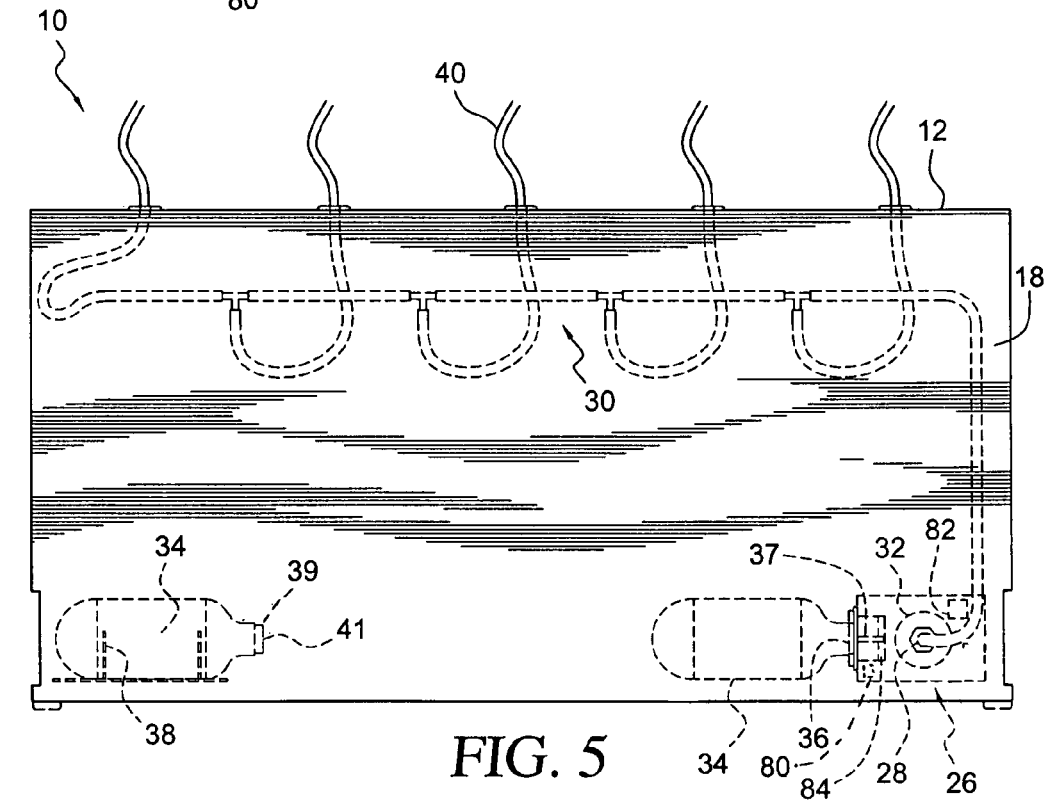
FIG. 5 is a rear plan view of the apparatus shown in FIG. 1.

In particular, and with reference to the first wine bottle 16 as shown in FIGS. 1, 2, 7, 8 and 9, the pressurized argon gas enters the pressurized gas supply assembly 26 and runs through the conduit arrangement 30 into the dispensing nozzle 42 where it is exposed to the upper surface 44 of the wine 46 and fills in any open space within the wine bottle 16 in a manner preventing the wine 46 from coming in contact with oxygen which would otherwise harm the quality of the wine 46. When the spring biased valve 48 at the dispensing end 50 of the dispensing nozzle 42 is actuated to open the passageway from the wine bottle 16 to the dispensing end 50 of the dispensing nozzle 42, the pressure of the argon gas forces the wine 46 upwardly through the draw tube 52 and out the dispensing end 50 of the dispensing nozzle 42 for collection within a wine glass. Since it is the argon gas that is pushing the wine 46 out, the argon gas fills the space created by the dispensing of the wine 46.

As those skilled in the art will certainly appreciate, it is very important that the free first end 72 of the draw tube 52 be positioned at the bottom 74 of the wine bottle 16 so that all of the wine may be dispensed in accordance with the present invention. With this in mind, the second end 76 of the draw tube 52 is mounted within the outlet lumen 78 of the dispensing nozzle 42 in a manner permitting the draw tube 52 to telescopically move within the outlet lumen 78 of the dispensing nozzle 42 (see FIG. 8).

As those skilled in the art will certainly appreciate, argon gas is very effective at preserving the wine 46. As such, it is critical that the present apparatus 10 provide for a closed system and that the dispensing nozzle 42 be securely mounted within the opening 43 of the wine bottle 16. Since the openings 43 of wine bottles 16 come in various shapes and often are not perfect circles, a connecting seal 54 for attaching the dispensing nozzle 42 within the opening 43 of the wine bottle 16 must be adapted to accommodate various wine bottles 16 without allowing leakage of either oxygen into the wine bottle 16 or argon out of the wine bottle 16.

With reference to FIGS. 1, 2, 7, 8 and 9, the connecting seal 54 of the dispensing nozzle 42 includes a first end 56 and a second end 58. The first end 56 is adjacent the free end 59 of the connecting seal 54 and is provided with a series of outwardly directed, flexible fins 60. The flexible fins 60 extend outwardly from a central supporting structure 62 and are shaped and dimensioned to engage the inner wall 64 defining the opening 43 of the wine bottle 16 once the dispensing nozzle 42 is secured thereto. In particular, the flexible fins 60 provide friction on the inner wall 64 of the opening 43 of the wine bottle 16, hold the dispensing nozzle 42 in place by resisting internal pressure created as the argon is pumped into the wine bottle 16, and conform to a variety of bottle opening 43 sizes. In addition, and due to the material from which they are composed, the fins will "reset" upon the application of hot water. With this in mind, the flexible fins 60 are composed of EVA, although other equivalent materials may be used without departing from the spirit of the invention.

Above the flexible fins 60 and extending from the central portion 66 to the second end 58 of the connecting seal 54 and adjacent the body 68 of the dispensing nozzle 42 is an outwardly tapered rubber seal member 70. In accordance with a preferred embodiment, the seal member 70 is composed of silicone rubber. Silicone rubber limits changes to the seal member 70 that may occur due to interaction thereof with the wine and gas. The seal member 70 tapers outwardly as it extends from the central portion 66 to the second end 58 of the connecting seal 54. The rubber seal member 70 provides a tight seal to prevent gas escape at pressures at, and slightly beyond, normal operating conditions. The rubber seal member 70 is shaped and dimensioned to conform to regular and varying bottle opening 43 sizes. While a rubber seal member is disclosed in accordance with a preferred embodiment of the present invention, other materials may be utilized without departing from the spirit of the present invention.

Through the application of the flexible fins 60 in combination with the tapered rubber seal member 70, and the utilization of different materials for the flexible fins 60 and the seal member 70, a dual seal arrangement is provided which accommodates variations in wine bottle size openings, allows for reuse of the dispensing nozzle without fully replacing the seal, and ultimately increases the flavor of the wine over time. In accordance with a preferred embodiment, the connecting seal 54 is shaped and dimensioned to accommodate wine bottle openings 43 ranging in size from approximately 17.25 mm to 19.5 mm.

In accordance with a preferred embodiment of the present invention, the flexible fins 60 and the rubber seal member 70 are distinct members secured about an inner substrate 86 of the connecting seal 54 to create the connecting seal 54. However, those skilled in the art will appreciate they may be integrally molded without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A preservation and dispensing apparatus, comprising:

a housing having a bottle support assembly;

a pressurized gas supply assembly for pressurizing and dispensing fluid from a bottle supported by the apparatus through the utilization of an inert gas in a manner that effectively creates a barrier protecting the fluid from harmful effects of oxygen;

the pressurized gas supply assembly includes an inert gas output linked to the bottle via a conduit arrangement and a dispensing nozzle selectively secured within an opening of the bottle;

the dispensing nozzle includes a connecting seal for attaching the dispensing nozzle within the opening of the bottle, the connecting seal includes a first end and a second end, the first end being adjacent a free end of the connecting seal and provided with a series of outwardly directed, flexible fins composed of a first material, the connecting seal further includes an outwardly tapered seal member composed of a second material and extending from a central portion of the connecting seal to the second end of the connecting seal, wherein the first material and the second material are different; and wherein the housing includes a bottom storage compartment and the inert gas output is stored within the storage compartment and the storage compartment includes a door, and the inert gas output is mounted to the door such that it pivots outwardly in a manner openly revealing the inert gas output.

2. The preservation and dispensing apparatus according to claim 1, wherein the housing includes a bottle support assembly including a base, a rear wall and a retaining member, and spring members are provided on the rear wall to assist in securely supporting a bottle between the rear wall and the retaining member.

3. The preservation and dispensing apparatus according to claim 2, wherein the spring members are convex leaf springs facing outwardly.

4. The preservation and dispensing apparatus according to claim 1, wherein the inert gas is argon.

5. The preservation and dispensing apparatus according to claim 1, wherein the inert gas output includes a regulator assembly to which a gas capsule is selectively secured.

6. The preservation and dispensing apparatus according to claim 5, wherein the regulator assembly includes a piercing pin that passes through an end cap of the gas capsule allowing gas from the gas capsule to pass through the regulator assembly.

7. The preservation and dispensing apparatus according to claim 5, wherein the regulator assembly reduces the gas pressure from approximately 2700 psi to approximately 5 psi.

8. The preservation and dispensing apparatus according to claim 7, wherein the regulator assembly reduces pressure in a single step.

9. The preservation and dispensing apparatus according to claim 5, wherein the regulator assembly includes a dump valve which monitors coupling of the gas capsule to the regulator assembly and releases pressure in the event a full or partially filled gas capsule is being removed.

10. The preservation and dispensing apparatus according to claim 5, wherein the regulator assembly includes a burst prevention system that will release pressure in the event undesirably high pressure is identified as coming from the gas capsule.

11. The preservation and dispensing apparatus according to claim 1, wherein the dispensing nozzle includes a draw tube which is mounted for telescopic movement within an outlet lumen of the dispensing nozzle.

12. The preservation and dispensing apparatus according to claim 1, wherein the flexible fins are composed of EVA.

13. The preservation and dispensing apparatus according to claim 1, wherein the seal member is composed of rubber.

14. The preservation and dispensing apparatus according to claim 13, wherein the seal member is composed of silicone rubber.

* * * * *